US005152211A

United States Patent [19]

Moody

[11] Patent Number: 5,152,211

[45] Date of Patent: Oct. 6, 1992

[54] IN-LINE HYDRAULIC DASHPOT

[75] Inventor: Paul E. Moody, Barrington, R.I.

[73] Assignee: The United States of America as represented by the Secretary of the Navy, Washington, D.C.

[21] Appl. No.: 674,638

[22] Filed: Mar. 25, 1991

[51] Int. Cl.[5] ..... F15B 13/04

[52] U.S. Cl. ..... 91/410; 91/448; 91/462; 91/355; 91/277

[58] Field of Search ..... 91/410, 355, 303, 277, 91/249, 448, 462; 137/101.19

[56] References Cited

U.S. PATENT DOCUMENTS

| | | | |
|---|---|---|---|
| 114,506 | 5/1871 | Knowles | 91/303 |
| 235,318 | 12/1880 | Vaile | 91/303 X |
| 2,699,150 | 1/1955 | Ziskal | 91/410 X |
| 2,743,704 | 5/1956 | Banker | 91/410 |
| 2,944,522 | 7/1960 | Doyle | 91/410 |
| 3,581,759 | 6/1971 | Veale | 137/101.19 |

FOREIGN PATENT DOCUMENTS

| | | | |
|---|---|---|---|
| 740329 | 10/1943 | Fed. Rep. of Germany | 91/303 |
| 2629564 | 1/1978 | Fed. Rep. of Germany | 91/277 |
| 371603 | 4/1932 | United Kingdom | 91/355 |

*Primary Examiner*—Edward K. Look
*Assistant Examiner*—Todd Mattingly
*Attorney, Agent, or Firm*—Michael J. McGowan; Prithvi C. Lall; Michael F. Oglo

[57] ABSTRACT

An in-line hydraulic dashpot is disclosed that effectively decelerates the piston of a power cylinder by controllably choking off the oil which is providing pressure to the piston. The in-line hydraulic dashpot of the invention includes a valve spool member movable between an open and closed position along a fluid flow path that supplies oil to the power cylinder. An actuator rod is cooperative with the valve spool member and the piston shaft of the power cylinder to move the valve spool member between its open and closed positions. The in-line hydraulic dashpot eliminates the clashing of mechanical parts and therewith eliminates the noise that would otherwise be generated thereby. The in-line hydraulic dashpot of the present invention makes possible the adaptation of a fixed stroke power cylinder to applications that call for a variable stroke length.

4 Claims, 2 Drawing Sheets

IN-LINE HYDRAULIC DASHPOT

STATEMENT OF GOVERNMENT INTEREST

The present invention may be manufactured and used by or for the Government of the United States of America for governmental purposes without the payment of any royalties thereon or therefor.

BACKGROUND OF THE INVENTION

1. Field of the Invention

This invention is directed to the field of hydraulic actuators, and more particularly, to an in-line hydraulic dashpot that substantially noiselessly decelerates a hydraulic power cylinder at any selected point of its power stroke.

2. Description of the Prior Art

Existing power cylinders are designed with a cup and cone dashpot built into either one or both ends of the power cylinder. The cone is normally a portion of the power cylinder's piston, while the cup is normally built into the end cap of the power cylinder.

For the principal portion of the stroke's length of travel, these pieces have no effect either on the speed or on the operation of the power cylinder itself. But, as the power cylinder approaches its end of travel, the cone starts to enter the cup.

The cone and cup are complementarily tapered. As the cone successively enters the cup, the amount of clearance between the two pieces continually decreases. As a result of the smaller and smaller exit area available for the oil or other hydraulic fluid to get out of the decreasing cup and cone cavity, the fluid builds an ever increasing pressure. This increasing pressure results in a force which resists the piston as it is being driven into the cup and slows the piston down so that when it reaches its end of stroke, its velocity has decreased to an extent that the mechanical impact, and hence noise, is minimized at the end of stroke.

Among the problems associated with the cup and cone dampers of the heretofore known power cylinders is the difficulty in providing consistent simultaneous cup/cone occurrence at the end of travel of the stroke of the piston of the power cylinder. Such could be caused to occur when the power cylinder is first installed by the proper positioning of the power cylinder with respect to the installation of the mechanism which is driven by the power cylinder, although such adjustment becomes disadvantageous to the extent that any change in the mechanism driven by the power cylinder, as caused by wear, system deflections, or the replacements of other parts of the total system, could result in the need to adjust the end of stroke of the power cylinder in a direction where no adjustment was in fact available. To accommodate such changes, it has been the practice heretofore to install the power cylinder so that the piston did not bottom out at the end of stroke. Although this provided the capability to adjust, if and as necessary, the final position of the piston at a later date, it paid the penalty of reducing the effectiveness of the power cylinder's cup and cone dashpot.

SUMMARY OF THE INVENTION

It is the principal object of the present invention to provide an in-line hydraulic dashpot for a power cylinder that is operable to provide damping action for either direction, or for both directions, of travel at any point selected along the stroke length of the power cylinder in such manner that noise is substantially eliminated.

In accord therewith, a valve having an open and a closed position is mounted in both the feed and in the return lines that supply hydraulic fluid to the power cylinder. The valves are nominally maintained in their open position when the cylinder is in a mid-stroke position. In further accord therewith a mechanical actuator is mechanically tied at any point along the stroke of travel of the power cylinder, one such mechanical actuator being mechanically tied thereto for each of the valves. As the power cylinder is moved by the hydraulic actuation thereof, and in dependance on the sense of travel and on the configuration of the actuators, the corresponding mechanical actuator actuates the associated valve, causing it to be controllably moved from its nominally open position to its closed position. The flow of hydraulic actuating fluid to the power cylinder is controllably interrupted as the corresponding valve is moved between its open and closed positions. Thereby, the piston of the power cylinder correspondingly is decelerated until it substantially noiselessly is caused to stop at the selected stroke length.

BRIEF DESCRIPTION OF THE DRAWINGS

These and other objects, features, and advantages of the present invention will become apparent as the invention becomes better understood by referring to the following detailed description of a preferred embodiment thereof, and to the drawings, wherein.

DESCRIPTION OF THE PREFERRED EMBODIMENT

Figure 1:
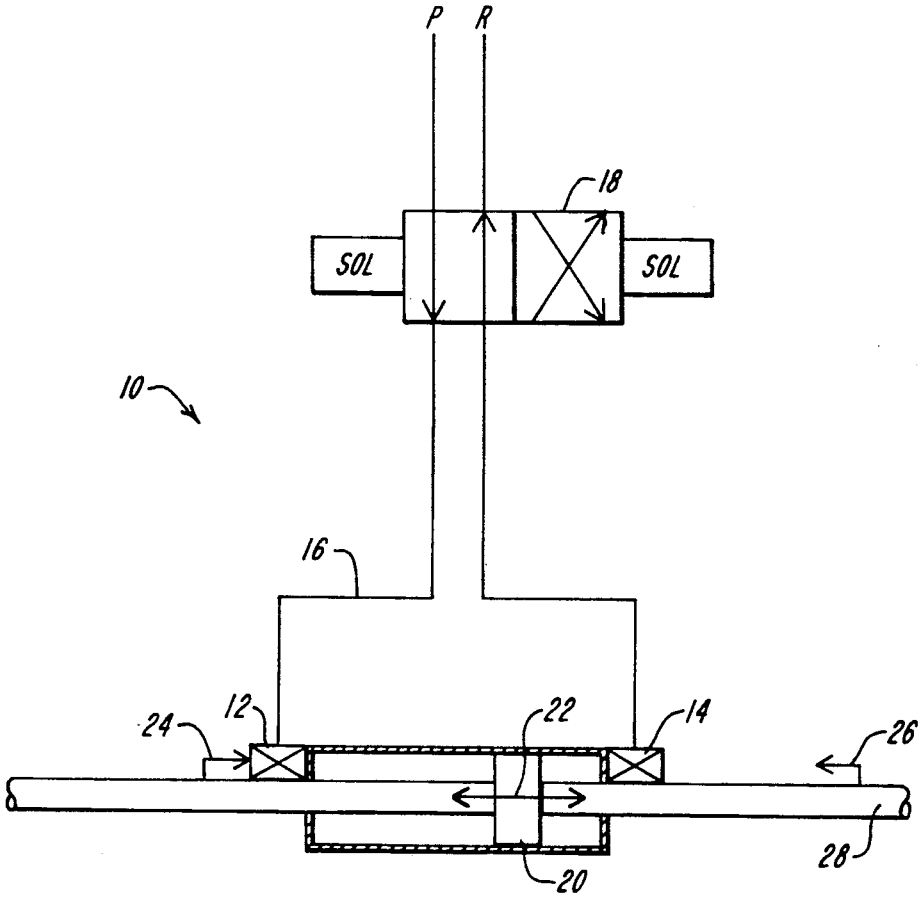
FIG. 1 is a block diagram illustrating the novel in-line hydraulic dashpot of the present invention.

Referring now to FIG. 1, generally designated as 10 is a block diagram of the novel in-line hydraulic damper of the present invention. First and second hydraulic dashpots 12, 14 to be described are in fluid communication with a hydraulic actuation fluid provided through conduit 16. As designated by letters "P", "R", representing "pressure" and "return", and in dependance upon the state of a solenoid-actuated control valve 18, the hydraulic actuation fluid, typically oil, is caused to flow through the conduit 16 in a counter-clockwise manner, as illustrated, or in a clockwise manner, not shown.

A power cylinder 20 is coupled to the fluid flow conduit 16 through the in-line dashpots 12 and 14. The power cylinder 20 may be capable of travel in either direction, as illustrated by double-headed arrow 22. While two in-line hydraulic dashpots 12 and 14 are illustrated, one being provided to control piston travel to the right in FIG. 1, and the other to control piston travel to the left in FIG. 1, it should be noted that a single in-line hydraulic dashpot for decelerating a power cylinder in only one direction may be provided without departing from the inventive concept.

The in-line hydraulic dashpots 12 and 14 are respectively mounted preferably to the housing of the power cylinder 20, but may be mounted to hardware, not illustrated, that is separate from the power cylinder 20, without departing from the inventive concept.

Actuators 24, 26 are respectively provided for the in-line hydraulic dashpots 12, 14, and are preferably mounted to shaft 28 in selected position to interrupt travel at a predetermined stroke length, although they may be mounted to other equipment physically attached to the shaft, not shown, without departing from the inventive concept.

Each of the actuators 24, 26 is operative in a manner to be described to actuate the corresponding in-line hydraulic dashpot 12, 14 at any selected stroke length of the power cylinder and for either or both directions of travel. The corresponding in-line hydraulic dashpot controllably interrupts the flow of hydraulic actuation fluid being supplied to the power cylinder. As the flow is caused to diminish to the zero f low rate, the piston of the power cylinder is brought to a condition of rest without generating the noise that would otherwise have arisen by an impact of mechanical pieces as in the heretofore known cup/cone power cylinder damping techniques.

Figure 2:
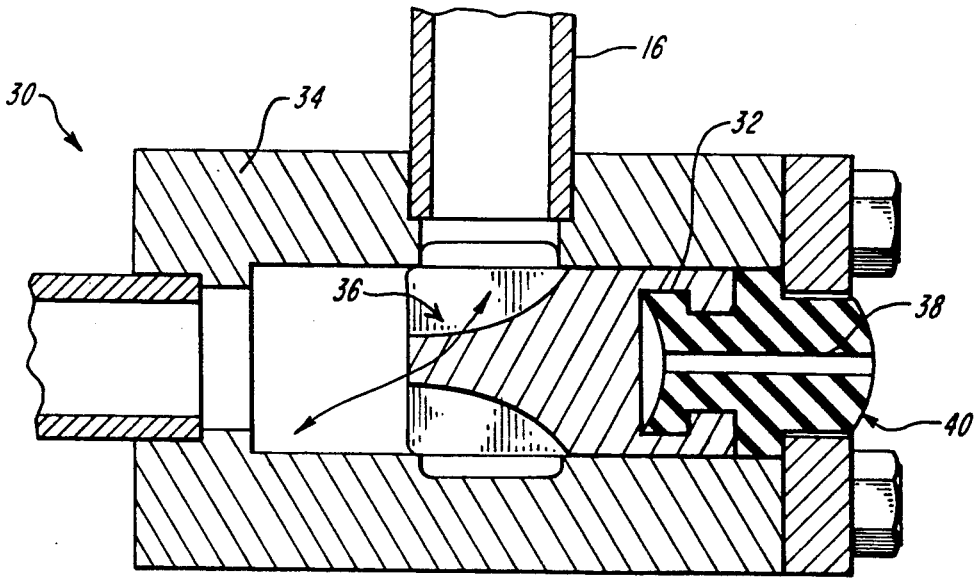
FIG. 2 is a top sectional view illustrating the valve of the in-line hydraulic dashpot of the present invention in its open 13 position.

Referring now to FIG. 2, generally designated as 30 is a top sectional view of an in-line hydraulic dashpot in accord with a preferred embodiment of the present invention in its open position. The dashpot 30 includes a valve spool member 32 mounted for sliding motion in a valve body member 34. The spool 32 in its open position is free of a fluid flow passageway, generally designated by arrow 36, through which hydraulic actuation fluid is supplied to the power cylinder along the conduit 16.

Figure 3:
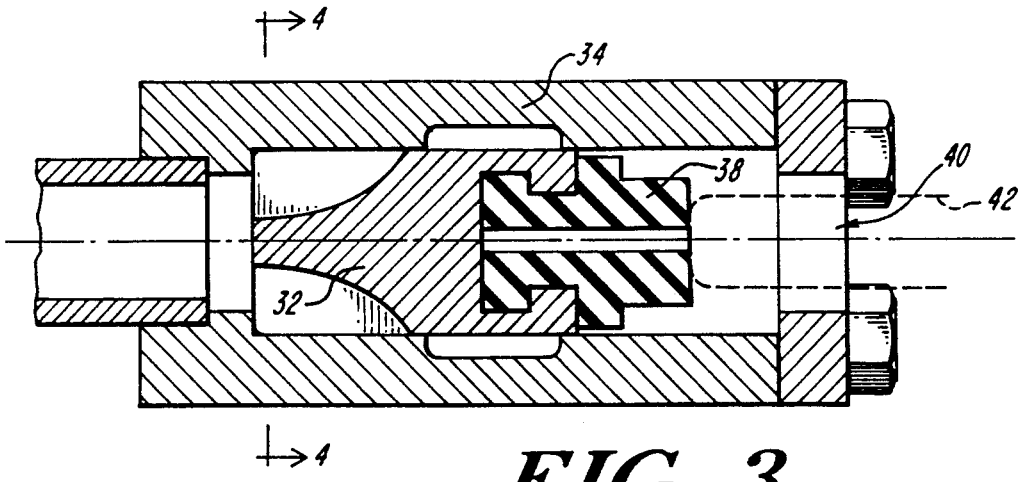
FIG. 3 is a side sectional view illustrating the valve of the 15 in-line hydraulic dashpot of the present invention in its closed position.

A resilient bumper 38 is mounted to the valve spool member 32 and extends through an opening generally designated 40 provided therefor in the valve body member 34 in position to receive an actuator rod illustrated in phantom outline at 42 in FIG. 3. The actuator rod 42, preferably mechanically tied in a manner to be described to any preselected portion of the shaft 28 of the power cylinder, is controllably brought through the opening 40 into contact with bumper 38 and moves the bumper 38, and therewith the valve spool member 32, from its open position, illustrated in FIG. 2, to its closed position, illustrated in FIG. 3.

Figure 4:
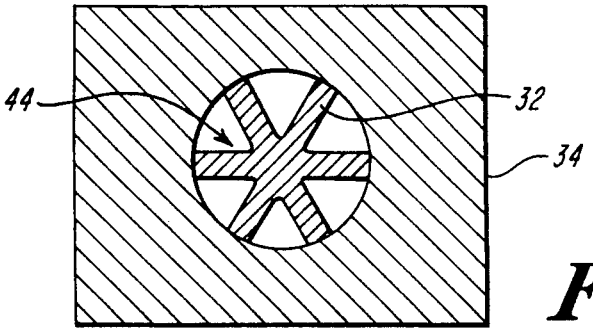
FIG. 4 is a sectional view taken along the lines 4—4 of FIG. 3.

As shown in FIG. 4, the valve spool member 32 is fluted as illustrated generally at 44. The valve spool member 32 preferably is a so-called fluted valve.

As the valve spool member 32 is moved between its open position and its closed position, the flutes of the fluted valve provide increasingly more flow restriction to the hydraulic actuation fluid being supplied along the fluid flow passageway 36 (FIG. 2) to the piston of the power cylinder. The velocity of flow of the hydraulic actuation fluid corresponds to the speed of the shaft of the power cylinder piston. With increasingly more flow restriction, the shaft of the power cylinder piston is correspondingly decelerated, until, with the flow completely cutoff, the power cylinder is at rest. Any suitable flute design may be provided to accomplish any intended deceleration characteristic for the power cylinder piston.

Figure 5:
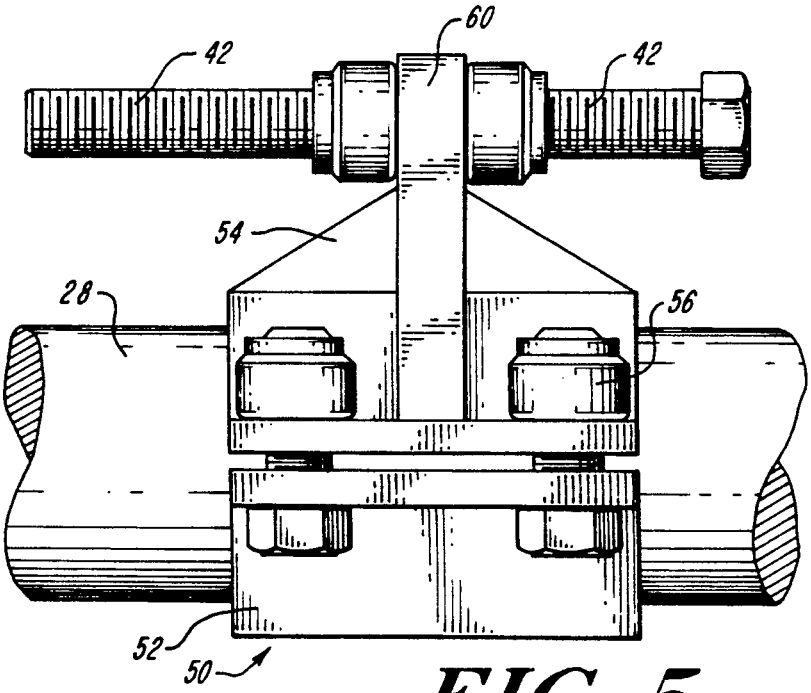
FIG. 5 is a side view of the actuator assembly of the in-line hydraulic dashpot of the present invention.

Referring now to FIG. 5, generally designated as 50 is a side view of the preferred embodiment of the mechanical tie assembly of the in-line hydraulic dashpot of the preferred embodiment of the present invention. The mechanical tie assembly includes first and second clamp members 52, 54 cooperative to surround the shaft. The members 52, 54 are fastened, as by threaded members 56, to the shaft 28 of the power cylinder. The clamp members 52, 54 may be clamped at any portion along the length of the shaft of the power cylinder selected to define the limit of intended stroke for a particular application.

The actuator rod 42 is mounted to upright 60 extending off of clamp member 54. Actuator rod 42 is preferably a machine screw which is threaded through upright 60 to provide fine adjustment for the position of the actuator rod 42. Lock nuts 62 and 63 lock actuator rod 42 in place once final adjustment has been made.

In operation, the solenoid-controlled valve 18 is actuated to supply hydraulic fluid for either clockwise or counterclockwise circulation to the power cylinder 20. For a selected direction of circulation, the power cylinder piston is moved in either one of its reciprocal directions. The hydraulic actuation fluid freely flows through the corresponding in-line hydraulic dashpot, so long as its associated valve spool member is in its nominal open position, and moves the piston of the power cylinder in the corresponding direction. The shaft of the power cylinder is correspondingly moved, and so is the actuator rod that is mounted for motion with the shaft of the power cylinder. Depending on the position of the actuator rod along the stroke of the shaft of the power cylinder, it sooner or later enters the actuator rod receiving opening provided therefor on the corresponding valve body member of the in-line hydraulic dashpot as the shaft is cycled through its stroke. With continued movement of the shaft of the power cylinder, the actuator rod bears against the associated resilient bumper and begins to move the attached spool valve member in the spool valve body from its nominal open position and toward its closed position With such movement, the flutes of the fluted spool valve member increasingly restrict the flow of hydraulic actuation fluid being supplied along the corresponding fluid flow passageway to the power cylinder. As the flow is decreased thereby, the motion of the shaft of the power cylinder is correspondingly decelerated, until the corresponding in-line hydraulic dashpot valve spool body has been moved by the associated actuator to its closed position. Whereupon, the flow of hydraulic actuation fluid is cut-off and the motion of the power cylinder is stopped at the preselected point along the stroke thereof.

The power cylinder remains inoperative until such time as the solenoid-actuated control valve is caused to reverse the flow of hydraulic actuation fluid. At such time, the hydraulic actuation fluid is caused to exert a force that moves the piston of the power cylinder in the reverse direction. The hydraulic actuating fluid flows freely through the other one of the in-line dashpots, which is in its nominally open position, and into the in-line hydraulic dashpot that is in its closed position. But since the hydraulic actuation fluid is now flowing in the reverse direction, a restoring force is generated that both moves the valve spool member from its closed position to its nominally open position and that withdraws the actuator rod out of the actuator rod receiving opening.

One advantage of the instant invention is that it provides effective deceleration of the motion of a power cylinder at the end of its stroke hydraulically, and thereby eliminates any impact load on the mechanism driven by the power cylinder, as well as any mechanical vibration, or noise, associated with rapid deceleration of mechanical parts.

Another advantage is that the working stroke, as manufactured, of a power cylinder is effectively decoupled from the requirements placed thereon by the system that it is to actuate, with no impact on effectiveness, so that the same power cylinder may be adopted as a standard for applications calling for different stroke lengths.

Many modifications of the presently disclosed invention will become apparent to those skilled in the art without departing from the inventive concept.

What is claimed is:

1. An in-line dashpot for controllably damping a hydraulically actuated power cylinder shaft having a shaft, at any preselected point of its stroke along a direction of travel, comprising:

a power cylinder comprising a shaft and at least one ported piston head, wherein said power cylinder shaft movement is a function both of rate of change of and rate of fluid flow ported to the piston head;

a hydraulic reservoir which provides hydraulic actuation fluid;

a fluid path coupled between the hydraulic reservoir and the power cylinder to provide feed and return of hydraulic actuation fluid from the reservoir to and from the power cylinder;

an in-line valve coupled in the path which opens and closes in response to control inputs to allow hydraulic actuation fluid to be fed from said reservoir into said power cylinder by circulating the hydraulic actuation fluid in one of a clockwise and a counter clockwise mode about said path such that the direction of feed and return through the path alternates in dependence on the mode;

a fluted spool valve seated in a valve body, situated in said fluid path and having an open position permitting hydraulic actuation fluid to flow between the hydraulic reservoir and the power cylinder, and a closed position completely interrupting hydraulic actuation fluid flow therebetween, said fluted spool valve having flutes that provide increasingly more flow restriction of the hydraulic actuation fluid as the spool valve is moved between its open and closed positions thereby controllably interrupting hydraulic actuation fluid flow to cause controlled deceleration of the stroke of the power cylinder shaft, said spool valve completely occluding fluid flow therethrough when it is in its closed position; and actuator means responsive to the position of the power cylinder shaft having reached said preselected point of its stroke for moving said fluted spool valve from its open to its closed position during operation in one of said clockwise and counter clockwise modes and for allowing the spool valve to be moved by the hydraulic actuation fluid itself from its closed to its open position during operation in the other of said modes.

2. The invention of claim 1, wherein said power cylinder is two-ported, one port to either side of its piston head, wherein said fluted spool valve is located in the fluid path to one side of the head, and further including another spool valve located in the same path to the other side of the head, and further including another actuator means and another spool valve cooperative to controllably cause deceleration of the stroke of said power cylinder shaft at any preselected point of its stroke along the reverse direction of travel in dependence on the mode and without reliance on the other spool valve to start and stop movement of the power cylinder.

3. The invention of claim 1, wherein said actuator means includes an actuator rod and means for mechanically tying the actuator rod to the power cylinder's shaft by said mechanically tying means.

4. The invention of claim 1, wherein said valve body has a face confronting said head and another face that faces away from the head that has an opening adapted to receive an actuator rod, and wherein said actuator means includes an actuator rod mechanically tied to said power cylinder shaft which is received through said opening in said valve body face facing away from said head for moving said fluted spool valve controllably between its opened and its closed condition.

* * * * *